US012305417B2

(12) United States Patent
Rogers et al.

(10) Patent No.: US 12,305,417 B2
(45) Date of Patent: May 20, 2025

(54) BRACKET ASSEMBLY CONFIGURED TO SUPPORT BEAMS RELATIVE TO ORCHESTRA PIT FILLERS OR STAGE EXTENSIONS

(71) Applicant: STAGERIGHT CORPORATION, Clare, MI (US)

(72) Inventors: Grant Rogers, Sanford, MI (US); Ryan Johnson, Clare, MI (US)

(73) Assignee: STAGERIGHT CORPORATION, Clare, MI (US)

( * ) Notice: Subject to any disclaimer, the term of this patent is extended or adjusted under 35 U.S.C. 154(b) by 311 days.

(21) Appl. No.: 18/107,205

(22) Filed: Feb. 8, 2023

(65) Prior Publication Data

US 2024/0263471 A1 Aug. 8, 2024

(51) Int. Cl.
*E04H 3/24* (2006.01)

(52) U.S. Cl.
CPC ..... *E04H 3/24* (2013.01)

(58) Field of Classification Search
CPC .... A63J 1/00; E04B 1/1903; E04B 2001/199; E04H 3/24
See application file for complete search history.

(56) References Cited

U.S. PATENT DOCUMENTS

| | | | | |
|---|---|---|---|---|
| 3,964,402 | A | 6/1976 | Jenne' et al. | |
| 5,848,501 | A | 12/1998 | Taipale et al. | |
| 6,581,339 | B2 | 6/2003 | Thiede | |
| 7,874,115 | B2 | 1/2011 | Thiede | |
| 9,631,385 | B1 * | 4/2017 | Phillips | E04C 2/44 |
| 10,221,581 | B2 | 3/2019 | Phillips | |
| 11,428,015 | B2 | 8/2022 | Huss et al. | |
| 2002/0116885 | A1 * | 8/2002 | Thiede | E04H 3/24 52/263 |
| 2004/0211137 | A1 * | 10/2004 | Thiede | E04B 5/02 52/272 |
| 2006/0185258 | A1 | 8/2006 | Ouellet et al. | |
| 2017/0226761 | A1 * | 8/2017 | Phillips | E04B 5/43 |
| 2022/0064965 | A1 * | 3/2022 | Huss | E04F 19/02 |
| 2022/0064975 | A1 | 3/2022 | Bechtol et al. | |
| 2024/0263472 | A1 * | 8/2024 | Rogers | A63J 1/00 |
| 2024/0392555 | A1 * | 11/2024 | Hsu | E04B 1/1903 |

FOREIGN PATENT DOCUMENTS

| | | |
|---|---|---|
| CN | 110878651 A | 3/2020 |
| GB | 2456817 B | 3/2010 |

OTHER PUBLICATIONS

Strata® Orchestra pit filler. Wenger. (n.d.). Retrieved Feb. 8, 2023, from https://shop.wengercorp.com/education/stratar-orchestra-pit-filler.html.

* cited by examiner

*Primary Examiner* — Rodney Mintz
(74) *Attorney, Agent, or Firm* — Carlson, Gaskey & Olds, P.C.

(57) ABSTRACT

This disclosure relates to a bracket assembly configured to support a beam relative to an orchestra pit filler or a stage extension. Among other benefits, the bracket assembly provides a robust connection point for beams and increases the case of assembling an orchestra pit filler or stage extension.

20 Claims, 7 Drawing Sheets

BRACKET ASSEMBLY CONFIGURED TO SUPPORT BEAMS RELATIVE TO ORCHESTRA PIT FILLERS OR STAGE EXTENSIONS

TECHNICAL FIELD

This disclosure relates to a bracket assembly configured to support a beam relative to an orchestra pit filler or a stage extension.

BACKGROUND

Theaters, including playhouses, opera houses, performing arts centers, and concert halls, typically include a stage for performers and a seating area for an audience. Some theaters also include an orchestra pit that is usually located in a lowered area between the stage and the seating area. In particular, the orchestra pit is typically immediately in front of the stage.

During stage performances that do not use an orchestra, the orchestra pit can be filled, either partially or fully. The orchestra pit may be filled using a system, referred to as an orchestra pit filler, that includes a frame assembly and a plurality of panels, which may be referred to as deck panels or simply decks. The panels are supported above the lowered area of the orchestra pit by the frame assembly. Stage extensions are systems, similar to orchestra pit fillers, that include a frame assembly supporting a plurality of panels in front of a stage.

Both orchestra pit fillers and stage extensions can be configured such that the deck panels are substantially aligned with the stage, such that the deck panels essentially increase the effective surface area of the stage, which allows stage performers to be closer to the seating area.

SUMMARY

In some aspects, the techniques described herein relate to a system for at least partially filling an orchestra pit or extending a stage, including: a frame assembly including a first beam and a second beam projecting non-parallel to the first beam; and a bracket assembly connected to the first beam, wherein the bracket assembly includes a connection section configured to interface with the second beam as the second beam moves vertically relative to the connection section.

In some aspects, the techniques described herein relate to a system, wherein: the bracket assembly includes a mounting plate configured to connect the bracket assembly to the first beam, and the connection section is arranged on an opposite side of the mounting plate as the first beam.

In some aspects, the techniques described herein relate to a system, wherein the connection section includes a first connection plate and a second connection plate spaced-apart from one another and arranged substantially parallel to one another.

In some aspects, the techniques described herein relate to a system, wherein: an end section of the second beam includes a recess and a cutout in a bottom thereof, the cutout leads to the recess from the bottom, and the first and second connection plates are sized and shaped to fit into the recess via the cutout.

In some aspects, the techniques described herein relate to a system, wherein: the end section of the second beam includes first and second sets of openings, the first and second connection plates include first and second sets of openings configured to align with the first and second sets of openings of the end section of the second beam when the first and second connection plates are within the recess, and first and second fastener assemblies are configured to connect the end section to the first and second connection plates via the first and second sets of openings of the end section and the first and second sets of openings of the first and second connection plates.

In some aspects, the techniques described herein relate to a system, wherein the first connection plate and the second connection plate are directly connected to the mounting plate.

In some aspects, the techniques described herein relate to a system, wherein the first connection plate and the second connection plate are indirectly connected to the mounting plate by a joint assembly.

In some aspects, the techniques described herein relate to a system, wherein the joint assembly permits rotation of the first connection plate and the second connection plate about an axis parallel to a face of the mounting plate.

In some aspects, the techniques described herein relate to a system, wherein the joint assembly includes: an intermediate plate connected to the first and second connection plates, first and second projections extending from the mounting plate toward the intermediate plate, first and second projections extending from the intermediate plate toward the mounting plate, and a fastener assembly configured to connect the first and second projections of the mounting plate to the first and second projections of the intermediate plate, respectively.

In some aspects, the techniques described herein relate to a system, wherein: the first beam includes a slotted channel, and a fastener assembly connects the mounting plate to the first beam via the slotted channel.

In some aspects, the techniques described herein relate to a system, wherein: a nut is arranged in the slotted channel, and a bolt extending through the mounting plate engages the nut to connect the bracket assembly to the first beam.

In some aspects, the techniques described herein relate to a system, wherein the mounting plate includes a locating tab projecting from the mounting plate adjacent a top of the slotted channel.

In some aspects, the techniques described herein relate to a system, wherein: the first beam includes a first capture channel above the slotted channel and open facing toward the slotted channel, and an upper edge of the mounting plate is received in the first capture channel.

In some aspects, the techniques described herein relate to a system, wherein: the first beam includes a second capture channel below the slotted channel and open facing toward the slotted channel, and a lower edge of the mounting plate is received in the second capture channel.

In some aspects, the techniques described herein relate to a system, wherein: the first beam includes a deck attachment channel arranged vertically above the first capture channel, the deck attachment channel includes a slot open facing a direction opposite the first capture channel, and a deck panel is connectable to the first beam via the deck attachment channel using a fastener assembly.

In some aspects, the techniques described herein relate to a method of at least partially filling an orchestra pit or extending a stage, including: arranging a bracket assembly relative to a first beam, wherein the bracket assembly includes a connection section; and interfacing a second beam relative to the bracket assembly by moving the second beam vertically relative to the connection section.

In some aspects, the techniques described herein relate to a method, further including: sliding the bracket assembly relative to the first beam.

In some aspects, the techniques described herein relate to a method, further including: rotating the connection section relative to the first beam.

In some aspects, the techniques described herein relate to a method, wherein: the connection assembly includes first and second plates arranged substantially parallel to one another, an end section of the second beam includes a recess and a cutout in a bottom thereof, the cutout leads to the recess from the bottom, and the step of interfacing a second beam relative to the bracket assembly includes inserting the first and second connection plates into the recess via the cutout.

In some aspects, the techniques described herein relate to a method, wherein: the end section of the second beam includes first and second sets of openings, the first and second connection plates each include first and second sets of openings configured to align with the first and second sets of openings of the end section when the first and second connection plates are within the recess, and the method includes connecting the end section to the first and second connection plates by inserting fastener assemblies through the first and second sets of openings of the end section and the first and second sets of openings of the first and second connection plates.

DETAILED DESCRIPTION

This disclosure relates to a bracket assembly configured to support a beam relative to an orchestra pit filler or a stage extension. Among other benefits, the bracket assembly provides a robust connection point for beams and increases the ease of assembling an orchestra pit filler or stage extension.

Figure 1:
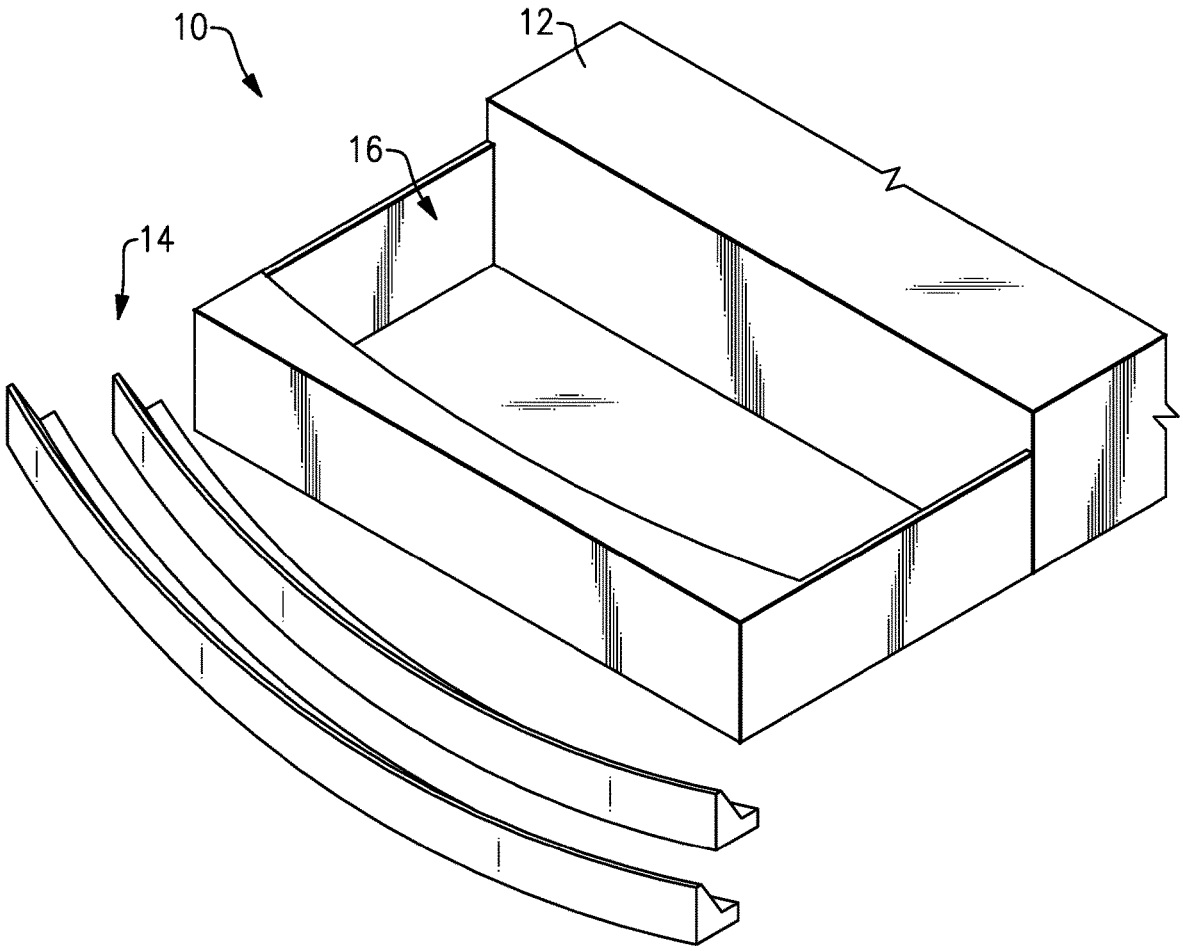
FIG. 1 is a perspective view of a portion of a theatre, including an orchestra pit.

FIG. 1 illustrates a portion of a theatre 10 from a perspective of an audience. The theatre 10 includes a stage 12, a seating area 14, and an orchestra pit 16. The orchestra pit 16 is a lowered area between the stage 12 and the seating area 14. In this example, the orchestra pit 16 is immediately in front of the stage 12.

This disclosure is not limited to any particular type of theatre 10. To this end, the term theatre is used broadly in this disclosure to refer to any venue with a stage and a seating area, including playhouses, opera houses, performing arts centers, concert halls, auditoriums, etc. The term theatre is inclusive of venues with stages that are fixed or portable, and is further inclusive of venues with seating areas that have fixed, retractable, or portable seats.

This disclosure is not limited to venues with an orchestra pit. To this end, while orchestra pit fillers are mentioned herein, this disclosure extends to stage extensions.

Figure 2:
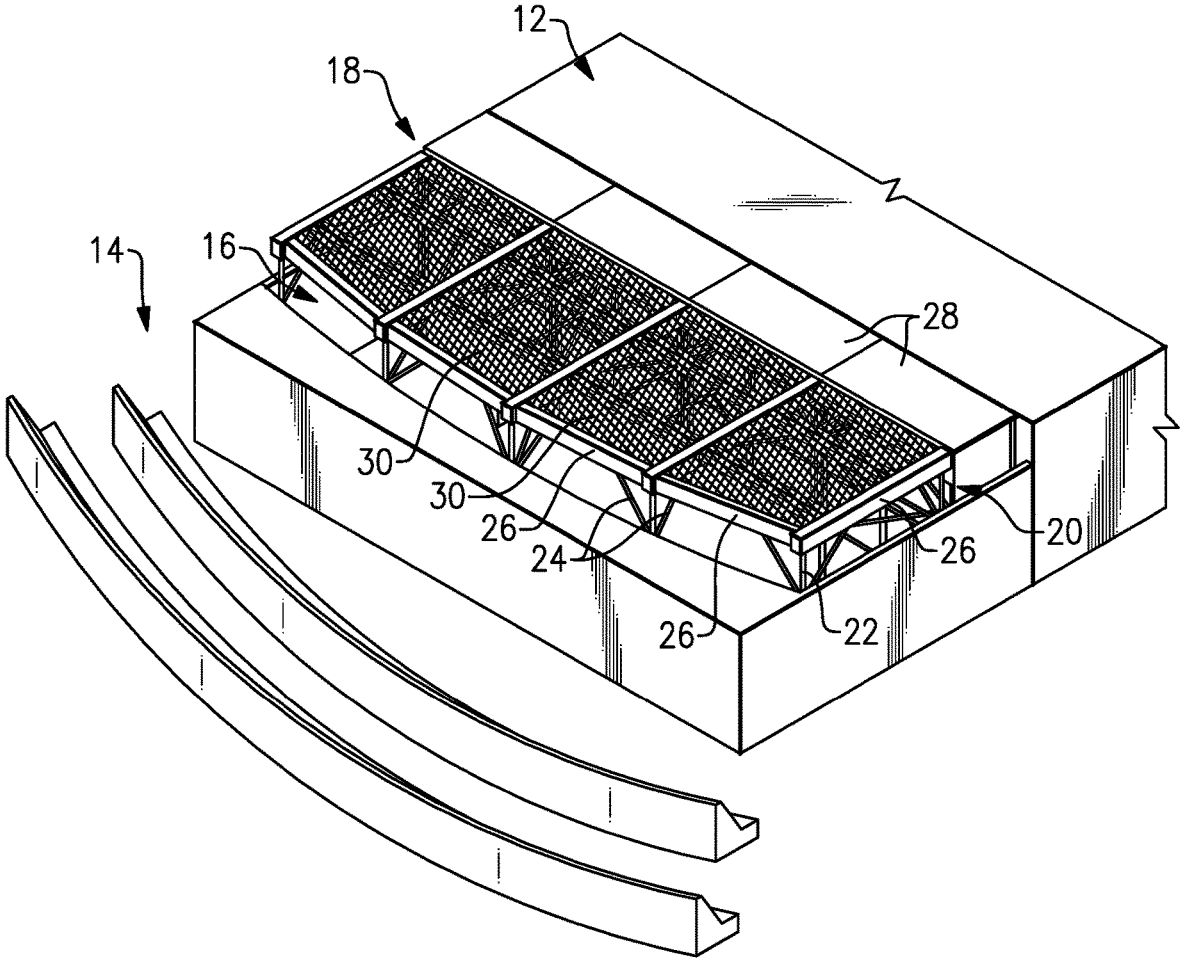
FIG. 2 is a similar view to FIG. 1, but illustrates an orchestra pit filler.
Figure 3:
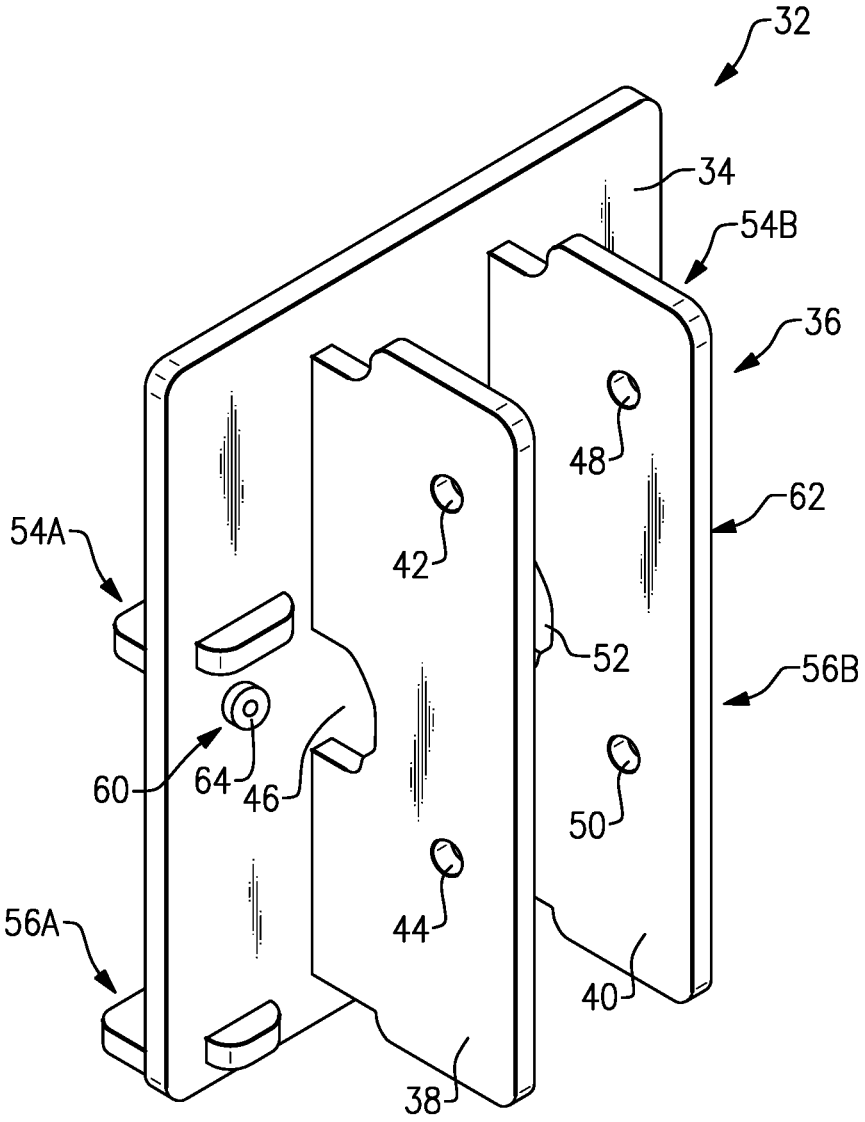
FIG. 3 is a perspective view of an example bracket assembly.

FIG. 2 illustrates the same portion of the theatre 10 of FIG. 1, but with an orchestra pit filler 18 arranged in the orchestra pit 16. In this example, the orchestra pit filler 18 includes a frame assembly 20 including a plurality of vertically-extending legs 22, braces 24, and beams 26. The beams 26 are supported adjacent a top of the legs 22 and are configured to support deck panels 28 and/or tension grid panels 30. As shown in FIG. 2, the frame assembly 20 supports a plurality (specifically, four) deck panels 28 such that the deck panels 28 abut a front edge of the stage 12 and such that a top of the deck panels 28 is substantially vertically aligned with a top of a front portion of the stage 12. In this way, the deck panels 28 are readily accessed from the stage 12, and performers and/or set pieces can be supported by the deck panels 28, which effectively increases the surface area of the stage 12.

In this example, the deck panels 28, which may be referred to simply as decks, are substantially solid and may be made primarily of a wood or composite material, for example. The orchestra pit filler 18 also includes a plurality of tension grid panels 30 supported by the frame assembly 20.

The beams 26 are connected to one another by bracket assemblies, in this disclosure. A first example bracket assembly 32 will now be described relative to FIGS. 3-6. The bracket assembly 32 is particularly suited to facilitate connections of two beams that are arranged substantially perpendicular to one another.

With joint reference to FIGS. 3-6, the bracket assembly 32 includes a mounting plate 34 and a connection section 36. The mounting plate 34 is configured to connect to the bracket assembly 32 to a first of the beams 26, which here is labeled 26A, and the connection section 36 is configured to facilitate a connection of a second of the beams 26, which here is labeled 26B, to the first beam 26A. The connection section 36 is arranged on an opposite side of the mounting plate 34 as the first beam 26A.

The connection section 36 includes a first connection plate 38 and a second connection plate 40. The first and second connection plates 38, 40 are connected directly to the mounting plate 34 in this example. The first and second connection plates 38, 40 are spaced-apart from one another and are arranged substantially parallel to one another. The first and second connection plates 38, 40 lie in planes substantially perpendicular to a plane within which the mounting plate 34 lies.

With reference to the first connection plate 38, the first connection plate 38 includes a first opening 42 and a second opening 44. The first and second openings 42, 44 are configured to receive a portion of a fastener assembly, as will be described below. Adjacent the mounting plate 34, the first connection plate 38 includes a slot 46 permitting tool access, which increases the ease of connecting the mounting plate 34 to the first beam 26A. The second connection plate 40 is configured substantially identically to the first connection plate 38. Specifically, the second connection plate 40 also includes a first opening 48, a second opening 50, and slot 52 aligned with the corresponding structures of the first connection plate 38.

On opposite sides of the connection section 36, the mount plate 34 includes a first set of tabs 54A, 54B and a second set of tabs 56A, 56B (tabs 54B and 56B are not visible) vertically beneath the first set of tabs 54A, 54B. Each of tabs 54A, 54B, 56A, 56B projects from an opposite side of the mounting plate 34 as the connection section 36. The tabs 54A, 54B are vertically aligned and are above the tabs 56A, 56B, which are also vertically aligned. The tabs 54A, 54B, 56A, 56B are locating tabs. Specifically, tabs 54A, 54B are configured to abut a top of a slotted channel 58 of the first beam 26A, and tabs 56A, 56B are configured to abut a lower capture channel 59 of the first beam 26A.

The bracket assembly 32 further includes first and second fastener assemblies 60, 62 (second fastener assembly 62 is not visible) arranged vertically between respective first and second sets of tabs 54A, 54B, 56A, 56B. Together, the first and second fastener assemblies 60, 62 are configured to connect the bracket assembly 32 to the first beam 26A. The first and second fastener assemblies 60, 62 each include a bolt 64 and a nut 66. The nut 66 is arranged within the slotted channel 58, in this example. The first and second fastener assemblies 60, 62 can be loosened to permit the bracket assembly 32 to slide into position along the first beam 26A relative to the slotted channel 58. The first and second fastener assemblies 60, 62 can be tightened to hold a position of the bracket assembly 32 relative to the first beam 26A. Again, the slots 46, 52 of the first and second connection plates 38, 40 increase the ease of tool access relative to the bolts 64, for example.

Adjacent a top of the bracket assembly 32, the first beam 26A includes an upper capture channel 68 configured to capture an upper edge 70 of the mounting plate 34. The upper capture channel 68 is adjacent a top of the first beam 26A and is open facing toward the slotted channel 58, which is the vertical downward direction. A tab 72 defining a lateral boundary of the upper capture channel 68 projects vertically lower than the upper edge 70 of the mounting plate 34 such that deflection of the upper edge 70 is resisted by the tab 72.

Adjacent a bottom of the bracket assembly 32, the first beam 26A includes the lower capture channel 59, which is configured to capture a bottom edge 74 of the mounting plate 34. The lower capture channel 59 is adjacent a bottom of the first beam 26A and is open facing toward the slotted channel 58, which is the vertical upward direction. A tab 76 defining a lateral boundary of the lower capture channel 59 projects vertically above than the bottom edge 74 of the mounting plate 34 such that deflection of the bottom edge 74 is resisted by the tab 76.

The beam 26 also includes a deck attachment channel 78 arranged vertically above the upper capture channel 68. The deck attachment channel 78 includes a slot open facing a direction opposite the upper capture channel 68, which is vertically upward. A fastener assembly, which includes a nut 80 in the deck attachment channel 78 and a bolt, is configured to connect a deck panel 28 to the first beam 26A.

Figure 4:
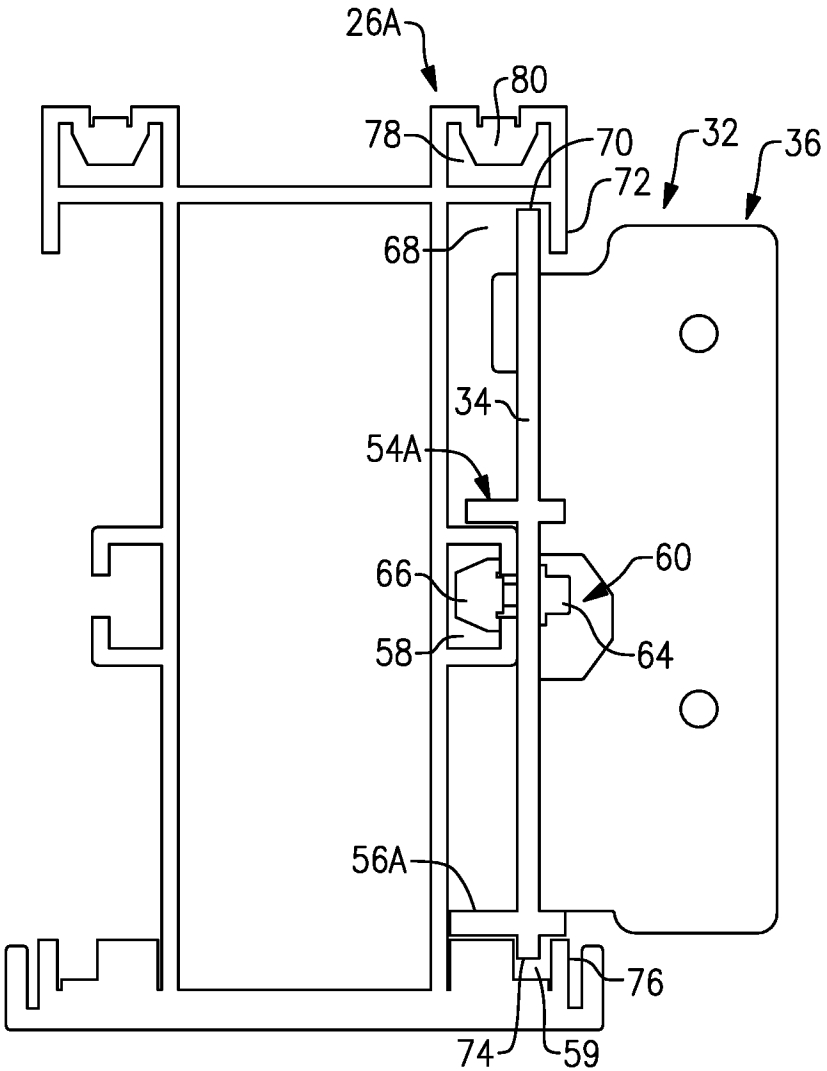
FIG. 4 is an end view of the bracket assembly relative to a first beam.

Only one side of the first beam 26A has been described. It should be understood that the first beam 26A is symmetrical about its centerline in this example, as shown in FIG. 4.

Figure 5:
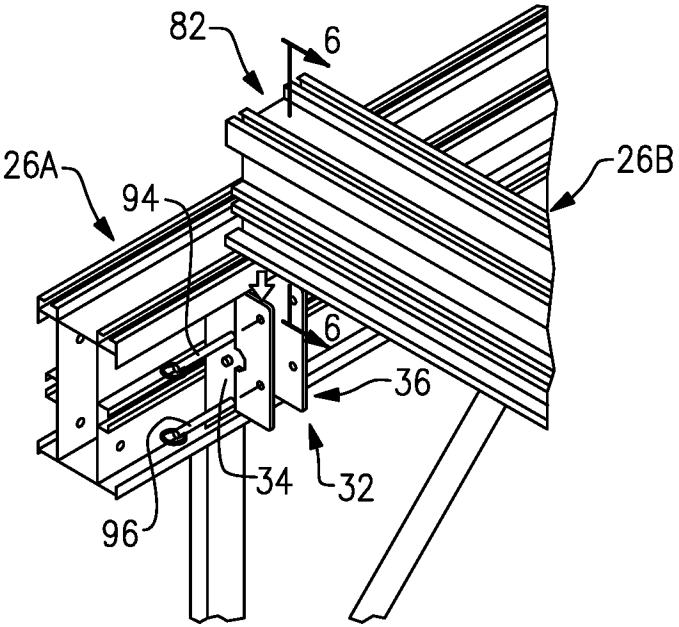
FIG. 5 is a perspective view of the bracket assembly relative to the first beam, and illustrates a portion of a second beam vertically above the bracket assembly.

The bracket assembly 32, and in particular the connection section 36, is configured to configured to permit an end section of the second beam 26B to interface with the connection section 36 by moving vertically relative to the connection section 36, as generally shown in FIG. 5.

Figure 6:
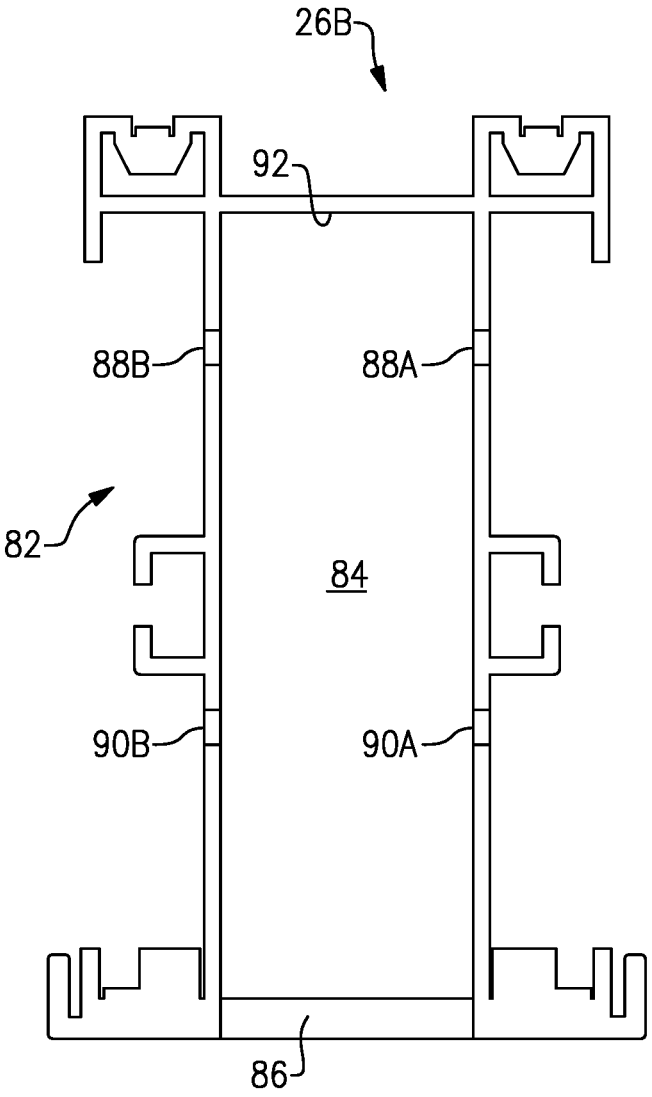
FIG. 6 is an end view of an end section of the second beam.

An end section 82 of the second beam 26B is shown in FIG. 6. As shown, the end section 82 of the second beam 26 includes a recess 84 and a cutout 86 in a bottom thereof. The cutout 86 leads to the recess 84 from the bottom. Further, the end section 82 of the second beam 26B includes a first set of openings 88A, 88B and a second set of openings 90A, 90B vertically beneath the first set of openings 88A, 88B.

The first and second connection plates 38, 40 are sized and shaped to fit into the recess 84 via the cutout 86 as the second beam 26B is moved vertically relative to the connection section 36. When the first and second connection plates 38, 40 are fully within the recess 84, a top of the first and second connection plates 38, 40 may contact a top wall 92 of the recess. Further, the openings 42, 44, 48, 50 are configured to vertically align with corresponding ones of the openings 88A, 88B, 90A, 90B. Specifically, openings 42 and 48 vertically align with openings 88A, 88B, and openings 44 and 50 vertically align with openings 90A, 90B. When aligned, fastener assemblies 94, 96 are able to pass through the respective aligned sets of openings to connect the second beam 26B to the bracket assembly 32. The fastener assemblies 94, 96 may be cotter pins, nuts/bolts, etc.

In another aspect of this disclosure, a bracket assembly is provided such that the first beam 26A can connect to a second beam 26B that is inclined relative to the first beam 26A. Such bracket assemblies are useful when providing an orchestra pit filler relative to an orchestra pit that exhibits a curved wall, for example. One example of such a bracket assembly 98 is shown in FIGS. 7 and 8.

Figure 8:
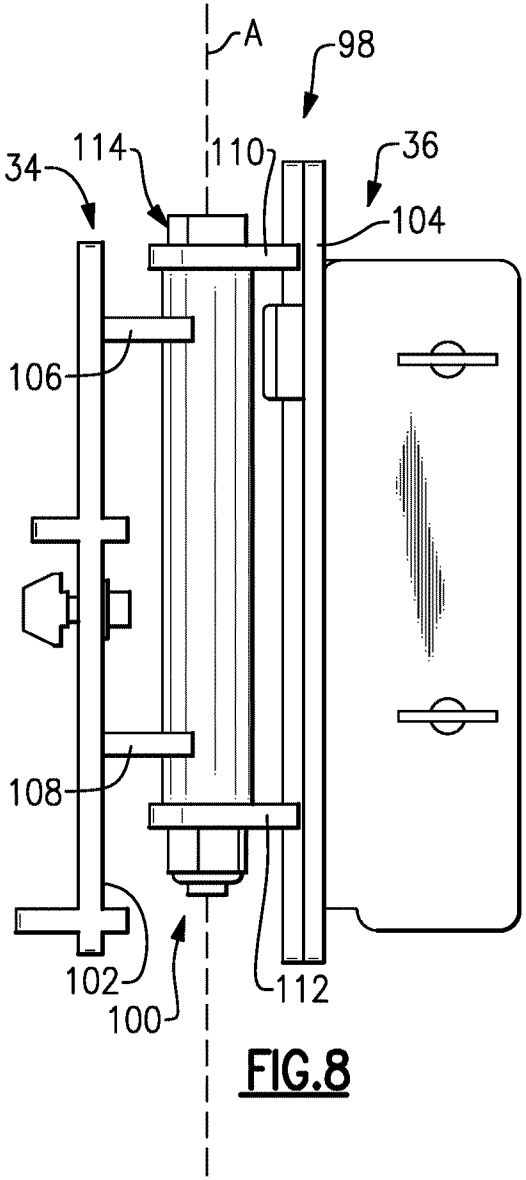
FIG. 8 is an end view of the bracket assembly of FIG. 7.
Figure 7:
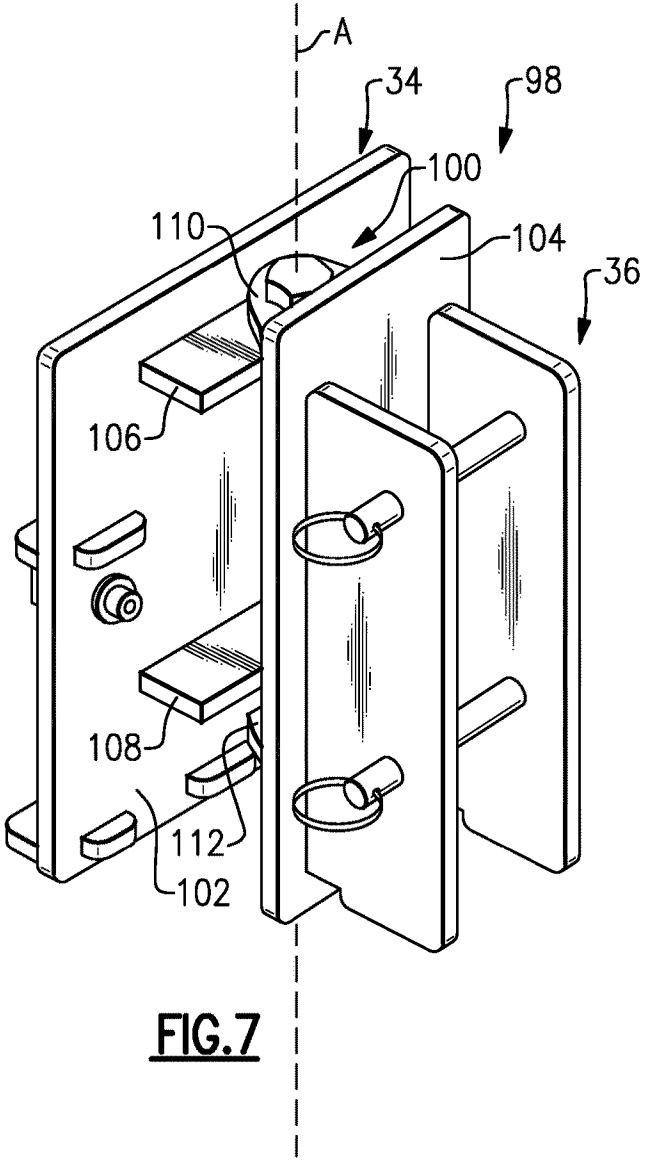
FIG. 7 is a perspective view of another example bracket assembly.

With joint reference to FIGS. 7 and 8, the bracket assembly 98 includes a mounting plate 34 configured to interface with the first beam 26A in substantially the same manner as in the previous embodiment. Further, the bracket assembly 98 includes a connection section 36 configured to interface with the second beam 26B in substantially the same manner as in the previous embodiment. The bracket assembly 98, however, includes a joint assembly 100 connecting the mounting plate 34 to the connection section 36.

In this embodiment, the joint assembly 100 permits rotation of the connection section 36, which includes the first connection plate 38 and the second connection plate 40, about an axis A parallel to a face 102 of the mounting plate. As such, the bracket assembly 98 can interface with a second beam 26B inclined at an angle non-parallel to the first beam 26A. While the bracket assembly 98 can be used relative to configurations in which the second beam 26B is perpendicular to the first beam 26A, the bracket assembly 98 is particularly suited to connect second beams 26B that are inclined both non-parallel to and non-perpendicular to the first beam 26A.

The joint assembly 100 includes an intermediate plate 104 connected to the first and second connection plates 38, 40. Further, first and second projections 106, 108 extend from the mounting plate 34 toward the intermediate plate 104. Additionally, first and second projections 110, 112 extend from the intermediate plate 104 toward the mounting plate 34. A fastener assembly 114 is configured to rotatably connect the first and second projections 106, 108 to first and second projections 110, 112 to permit rotation of the connection section 36 about the axis A. In this example, the fastener assembly 114 includes a shaft arranged about axis A.

While two example bracket assemblies have been described, it should be understood that this disclosure extends to orchestra pit fillers and stage extensions that include either type of bracket assembly. Further, this disclosure extends to orchestra pit fillers or stage extensions with different types of bracket assemblies within the same orchestra pit filler or stage extension.

Figure 9:
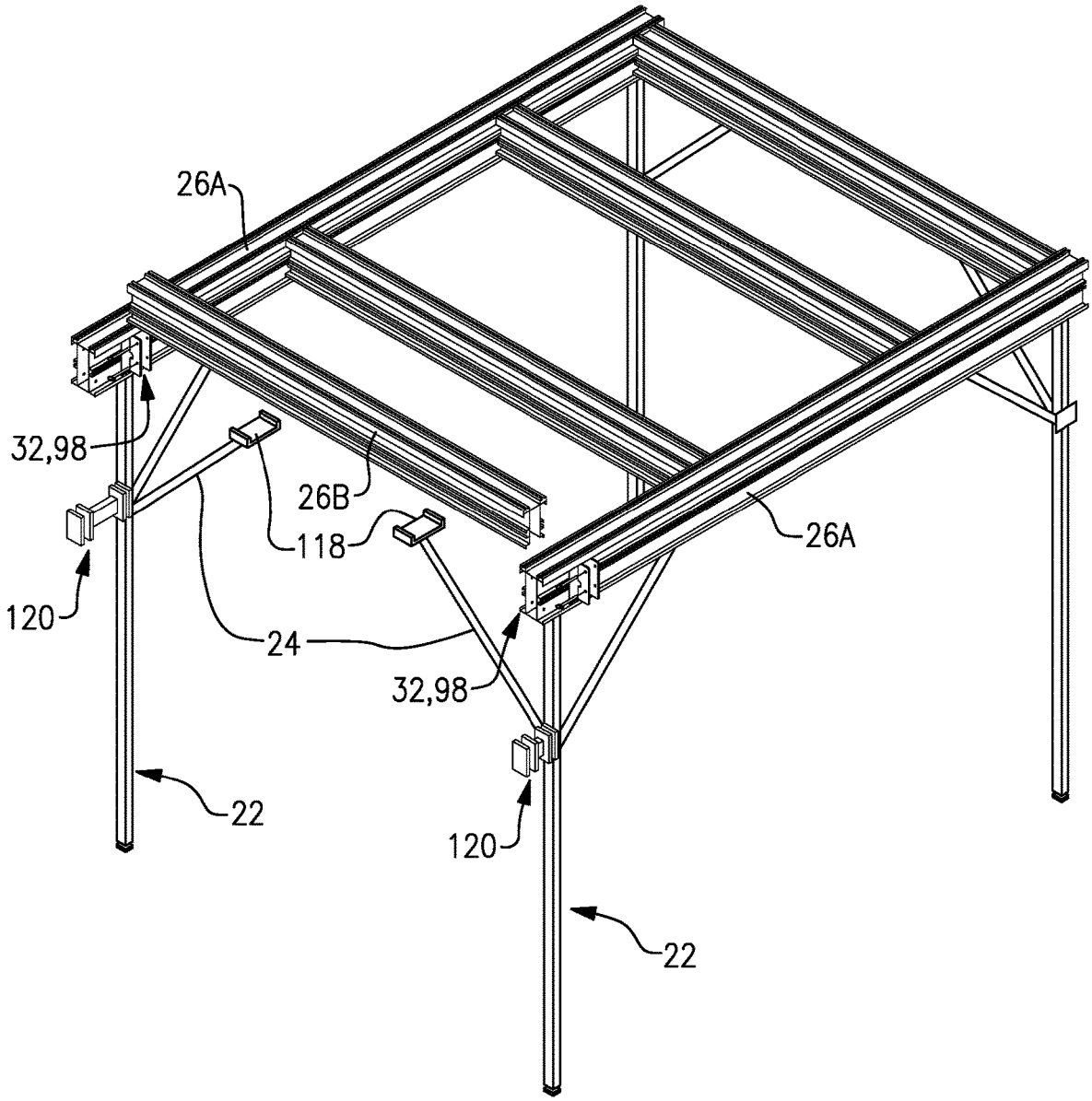
FIG. 9 is a perspective view of a portion of a frame assembly.

Further, while only one end of the second beam 26B has been described, both ends of the second beam 26B may be configured to interface with similar bracket assemblies. As shown in FIG. 9, a second beam 26B is being lowered vertically relative to two first beams 26A. Both ends of the second beam 26B are configured to interface with one of the bracket assemblies 32, 98. Further, in this example, braces 24 include support channels 118 configured to receive and support the second beam 26B from below, which reduces a load on the bracket assemblies 32, 98.

Additionally, legs 22 are fitted with horizontal stand-offs 120 of varying sizes corresponding to a distance between the legs 22 and a side wall of the orchestra pit 16. The stand-offs contact a side wall of the orchestra pit 16 to resist movement of the orchestra pit filler 18, which increases the ease of assembling the beams 26 and reduces a load on the bracket assemblies 32, 98.

It should be understood that terms such as "vertical," "lateral," "upward," and "downward" are used above with reference to the normal meaning with reference to the normal orientation of the structures described in the drawings. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A system for at least partially filling an orchestra pit or extending a stage, comprising:

a frame assembly connected to the stage, the frame assembly including a first beam and a second beam projecting non-parallel to the first beam, wherein the first beam includes a deck attachment channel;

a deck panel connected to the deck attachment channel with a fastener assembly, the deck panel positioned adjacent to a front edge of the stage; and a bracket assembly connected to the first beam, wherein the bracket assembly includes a connection section configured to interface with the second beam as the second beam moves vertically relative to the connection section.

2. The system as recited in claim 1, wherein:

the bracket assembly includes a mounting plate configured to connect the bracket assembly to the first beam, and the connection section is arranged on an opposite side of the mounting plate as the first beam.

3. The system as recited in claim 2, wherein the connection section includes a first connection plate and a second connection plate spaced-apart from one another and arranged substantially parallel to one another.

4. The system as recited in claim 3, wherein the first connection plate and the second connection plate are directly connected to the mounting plate.

5. The system as recited in claim 3, wherein:

an end section of the second beam includes a recess and a cutout in a bottom thereof, the cutout leads to the recess from the bottom, and the first and second connection plates are sized and shaped to fit into the recess via the cutout.

6. The system as recited in claim 5, wherein:

the end section of the second beam includes first and second sets of openings, the first and second connection plates include first and second sets of openings configured to align with the first and second sets of openings of the end section of the second beam when the first and second connection plates are within the recess, and first and second fastener assemblies are configured to connect the end section to the first and second connection plates via the first and second sets of openings of the end section and the first and second sets of openings of the first and second connection plates.

7. The system as recited in claim 3, wherein the first connection plate and the second connection plate are indirectly connected to the mounting plate by a joint assembly.

8. The system as recited in claim 7, wherein the joint assembly permits rotation of the first connection plate and the second connection plate about an axis parallel to a face of the mounting plate.

9. The system as recited in claim 8, wherein the joint assembly includes:

an intermediate plate connected to the first and second connection plates, first and second projections extending from the mounting plate toward the intermediate plate, first and second projections extending from the intermediate plate toward the mounting plate, and a fastener assembly configured to connect the first and second projections of the mounting plate to the first and second projections of the intermediate plate, respectively.

10. The system as recited in claim 3, wherein:

the first beam includes a slotted channel, and a fastener assembly connects the mounting plate to the first beam via the slotted channel.

11. The system as recited in claim 10, wherein:

a nut is arranged in the slotted channel, and a bolt extending through the mounting plate engages the nut to connect the bracket assembly to the first beam.

12. The system as recited in claim 11, wherein the mounting plate includes a locating tab projecting from the mounting plate adjacent a top of the slotted channel.

13. The system as recited in claim 11, wherein:

the first beam includes a first capture channel above the slotted channel and open facing toward the slotted channel, and an upper edge of the mounting plate is received in the first capture channel.

14. The system as recited in claim 13, wherein:

the first beam includes a second capture channel below the slotted channel and open facing toward the slotted channel, and a lower edge of the mounting plate is received in the second capture channel.

15. The system as recited in claim 13, wherein:

the deck attachment channel is arranged vertically above the first capture channel, and the deck attachment channel includes a slot open facing a direction opposite the first capture channel.

16. A method of at least partially filling an orchestra pit or extending a stage, comprising:

providing the system of claim 1; and arranging a bracket assembly relative to a first beam, wherein the bracket assembly includes a connection section; and interfacing a second beam relative to the bracket assembly by moving the second beam vertically relative to the connection section.

17. The method as recited in claim 16, further comprising:

sliding the bracket assembly relative to the first beam.

18. The method as recited in claim 16, further comprising:

rotating the connection section relative to the first beam.

19. The method as recited in claim 16, wherein:

the connection assembly includes first and second plates arranged substantially parallel to one another, an end section of the second beam includes a recess and a cutout in a bottom thereof, the cutout leads to the recess from the bottom, and the step of interfacing a second beam relative to the bracket assembly includes inserting the first and second connection plates into the recess via the cutout.

20. The method as recited in claim 19, wherein:

the end section of the second beam includes first and second sets of openings, the first and second connection plates each include first and second sets of openings configured to align with the first and second sets of openings of the end section when the first and second connection plates are within the recess, and the method includes connecting the end section to the first and second connection plates by inserting fastener assemblies through the first and second sets of openings of the end section and the first and second sets of openings of the first and second connection plates.

* * * * *